US010039162B1

(12) United States Patent
Guan et al.

(10) Patent No.: US 10,039,162 B1
(45) Date of Patent: Jul. 31, 2018

(54) LIGHT EMITTING DIODE LIGHT DEVICE

(71) Applicant: FOSHAN NATIONSTAR OPTOELECTRONICS CO., LTD., Foshan, Guangdong (CN)

(72) Inventors: Jingrui Guan, Guangdong (CN); Tiezhu Wang, Guangdong (CN); Mian Wang, Guangdong (CN); Shiquan Liang, Guangdong (CN)

(73) Assignee: FOSHAN NATIONSTAR OPTOELECTRONICS CO., LTD., Foshan, Guangdong (CN)

( * ) Notice: Subject to any disclaimer, the term of this patent is extended or adjusted under 35 U.S.C. 154(b) by 0 days.

(21) Appl. No.: 15/839,598

(22) Filed: Dec. 12, 2017

(30) Foreign Application Priority Data

Sep. 18, 2017 (CN) ..... 2017 1 0843232

(51) Int. Cl.
*H05B 37/02* (2006.01)
*H05B 33/08* (2006.01)

(52) U.S. Cl.
CPC ..... *H05B 33/0815* (2013.01); *H05B 33/089* (2013.01); *H05B 33/0842* (2013.01); *H05B 37/0281* (2013.01)

(58) Field of Classification Search
CPC .... H05B 41/34; H05B 33/0803; H05B 39/09; H05B 41/28; H05B 33/0809; H05B 33/0815; H05B 33/0818; H05B 41/2828; H05B 41/3921; H05B 41/3927; H05B 37/029; H05B 37/02; H05B 37/0254; H05B 33/0857; H05B 33/0863; H05B 41/42; H05B 33/0827; H05B 33/0851; H05B 33/083; F21W 2131/406; G05B 19/14; F21Y 2101/02; B23K 9/0732; B23K 9/1012; B23K 9/1031; B23K 9/1087; G09G 3/2014
See application file for complete search history.

(56) References Cited

U.S. PATENT DOCUMENTS 8,493,003 B2 * 7/2013 Zhao ..... H05B 33/0857 315/308
2009/0187925 A1 * 7/2009 Hu ..... H05B 33/0815 719/327

* cited by examiner

*Primary Examiner* — Minh D A

(57) ABSTRACT

A light emitting diode (LED) light device is provided, which includes an LED light and an LED light driving device connected with the LED light. A power regulating module in the LED light driving device includes at least two equivalent resistors connected in parallel and a dip switch arranged in a branch where each of the equivalent resistors is located, the LED light may be regulated to output different power through different combinations of on-off states of the dip switches. The dip switches are arranged at an opening on a surface of the housing.

10 Claims, 4 Drawing Sheets

LIGHT EMITTING DIODE LIGHT DEVICE

CROSS REFERENCE TO RELATED APPLICATION

The present application claims priority to Chinese Patent Application No. 201710843232.7, titled "LIGHT EMITTING DIODE LIGHT DEVICE", filed on Sep. 18, 2017 with the State Intellectual Property Office of the PRC, which is incorporated herein by reference in its entirety.

FIELD

The present disclosure relates to the field of light emitting diode (LED) light, and particularly to an LED light device.

BACKGROUND

A basic structure of the light emitting diode (LED) is an electroluminescence chip made of a semiconductor material, and an LED light refers to an LED light device which emits light using the LED.

The existing LED light has fixed power generally. Power of an LED light is regulated by regulating output power of an LED light driving device using computer programs, and it is unable to regulate power of the LED light by the user, which results in regulation inconvenience, low practicability and high cost.

SUMMARY

An LED light device is provided in the present disclosure, to solve the technical problems in the existing LED light of being unable to regulate power of the LED light by the user, regulation inconvenience, low practicability and high cost.

An LED light device is provided in the present disclosure, which includes an LED light and an LED light driving device connected with the LED light. The LED light driving device includes a housing, a rectifying module, a constant-voltage module and a power regulating module. An input terminal of the rectifying module is connected with an alternating-current power supply, and an output terminal of the rectifying module is connected with an input terminal of the constant-voltage module. The rectifying module, the constant-voltage module and the power regulating module are arranged in the housing. The power regulating module includes a switch tube unit, a current sampling unit, a current regulating unit and a switch voltage-regulating unit. A drain of the switch tube unit is connected with an output terminal of the constant-voltage module, a source of the switch tube unit is connected with the current sampling unit and the LED light sequentially in series, and a gate of the switch tube unit is connected with a driving terminal of the current regulating unit. The current sampling unit is configured to sample a current flowing through the LED light, and convert the sampled current into a voltage signal. A sample input terminal of the current regulating unit is connected between the current sampling unit and the LED light, and the current regulating unit is configured to compare the voltage signal with a reference value, and control a switch-on time of the switch tube unit by controlling a duty cycle of a signal at the driving terminal based on a comparison result, to enable the sampled current to be the same as the reference value. An output terminal of the switch voltage-regulating unit is connected with an input terminal of the current regulating unit. The switch voltage-regulating unit includes at least two equivalent resistors connected in parallel and a dip switch arranged in a branch where each of the equivalent resistors is located. When a combination of on-off states of the dip switches is changed, an output voltage at the output terminal of the switch voltage-regulating unit is changed and the reference value is changed, to enable the LED light to output different power. The dip switches are arranged at an opening on a surface of the housing.

Preferably, the LED light device further includes an energy storage module connected in a branch where the current sampling unit is located, and the energy storage module is configured to store electric energy or discharge electric energy to prevent the sampled current from changing abruptly.

Preferably, the equivalent resistor is formed by at least two resistors connected in series, at least two resistors connected in parallel or at least three resistors connected together.

Preferably, the output terminal of the constant-voltage module is connected with a first filtering unit in parallel, to stabilize an output voltage.

Preferably, the LED light device further includes a second filtering unit connected between two terminals of the LED light in parallel.

Preferably, the LED light device further includes a third filtering unit connected between the alternating-current power supply and the rectifying module.

Preferably, the current sampling unit is a resistor R50, and the switch tube unit is a metal oxide semiconductor (MOS) transistor Q5.

Preferably, the current regulating unit includes a control chip U2, a resistor R38, a resistor R37, a capacitor C17 and a capacitor C18. A first terminal of the resistor R38 is connected with a gate of the MOS transistor Q5. A pin GATE of the control chip U2 is connected with a second terminal of the resistor R38, to control the MOS transistor Q5 to be switched on or switched off. The capacitor C17 is connected between a pin VC and a pin GND of the control chip U2. The capacitor C18 and the resistor R37 are connected in series between the pin VC and the pin GND of the control chip U2, to stabilize a loop of the control chip U2. A pin SENSE of the control chip U2 is connected with an output terminal of the resistor R50, to compare a sampled voltage signal with a voltage reference value, and control a duty cycle of an output signal at the pin GATE based on a comparison result. A pin VCC of the control chip U2 is connected with a power supply unit, to provide an operating voltage to the control chip U2. A pin ACTL of the control chip U2 is connected with the output terminal of the switch voltage-regulating unit.

Preferably, the switch voltage-regulating unit includes a resistor R43, a resistor R39, a resistor R40, a resistor R41, a resistor R42, a resistor R44, a capacitor C19 and dip switches SW. A first terminal of the resistor R43 is connected to a positive terminal of an external direct-current voltage source, and a negative terminal of the external direct-current voltage source is connected with the pin GND of the control chip U2. A second terminal of the resistor R43 is connected with the pin GND of the control chip U2 via the resistor R44. The second terminal of the resistor R43 is connected with the pin GND of the control chip U2 via the capacitor C19. The second terminal of the resistor R43 is connected with the pin ACTL of the control chip U2. The resistor R39, the resistor R40, the resistor R41 and the resistor R42 are connected in parallel between the second terminal of the resistor R43 and the pin GND of the control chip U2. The dip switches SW are connected in branches where the resistor R39, the resistor R40, the resistor R41 and the resistor R42 are located respectively, and a voltage at the pin ACTL of the control chip U2 is regulated by changing a combination of on-off states of the dip switches SW.

Preferably, the power supply unit includes a transformer winding N6, a diode D8, a voltage regulating transistor ZD2, a resistor R36, a resistor R46 and a capacitor C16. A first terminal of the transformer winding N6 is connected with an anode of the diode D8, and a second terminal of the transformer winding N6 is connected with the pin GND of the control chip U2. A cathode of the diode D8 is connected with a first terminal of the resistor R46. A second terminal of the resistor R46 is connected with a first terminal of the resistor R36 and the pin VCC of the control chip U2. A second terminal of the resistor R36 is connected with a cathode of the voltage regulating transistor ZD2 and the positive terminal of the external direct-current voltage source. An anode of the voltage regulating transistor ZD2 is connected with the pin GND of the control chip U2. A positive electrode of the capacitor C16 is connected with the pin VCC of the control chip U2, and a negative electrode of the capacitor C16 is connected with the pin GND of the control chip U2.

It can be seen from the above technical solutions that the present disclosure has advantages as follows.

The switch voltage-regulating unit includes at least two equivalent resistors connected in parallel and a dip switch arranged in a branch where each of the equivalent resistors is located. When a combination of on-off states of the dip switches is changed, a voltage of the switch voltage-regulating unit outputted to the current regulating unit is changed, and a reference value is changed correspondingly. The sample input terminal of the current regulating unit is connected between the current sampling unit and the LED light, and the current regulating unit is configured to compare a voltage signal converted by the current sampling unit with a reference value, and control a switch-on time of the switch tube unit by controlling a duty cycle of a signal at the driving terminal based on a comparison result, to enable the sampled current to be the same as the reference value. Since the branch where each of the equivalent resistors is located has two states: an on state and an off state, the number of the combinations of on-off states of the dip switches may be $2^N$, where N is the number of the equivalent resistors connected in parallel, the number of the reference values may be $2^N$, and $2^N$ different sampled current may be outputted. Since the current sampling unit is connected with the LED light in series, the LED light may output $2^N$ different power. The dip switches are arranged at an opening on a surface of the housing, and the manufacturer and the user can control the dip switches to be switched on or switched off at any time, and therefore regulate power of the LED light, thereby having advantages of regulation convenience, high practicability and low cost.

BRIEF DESCRIPTION OF THE DRAWINGS

In order to more clearly illustrate the technical solution in the embodiments of the present disclosure or in the conventional technology, drawings required in the description of the embodiments or the conventional technology will be introduced simply below. Obviously, the drawings in the following description are some embodiments of the present disclosure. For those skilled in the art, other drawings can also be obtained according to the drawings without any creative work.

DETAILED DESCRIPTION

An LED light device is provided according to the embodiments of the present disclosure, to solve the technical problems in the existing LED light of being unable to regulate the power of the LED light by the user, regulation inconvenience, low practicability and high cost.

Figure 1:
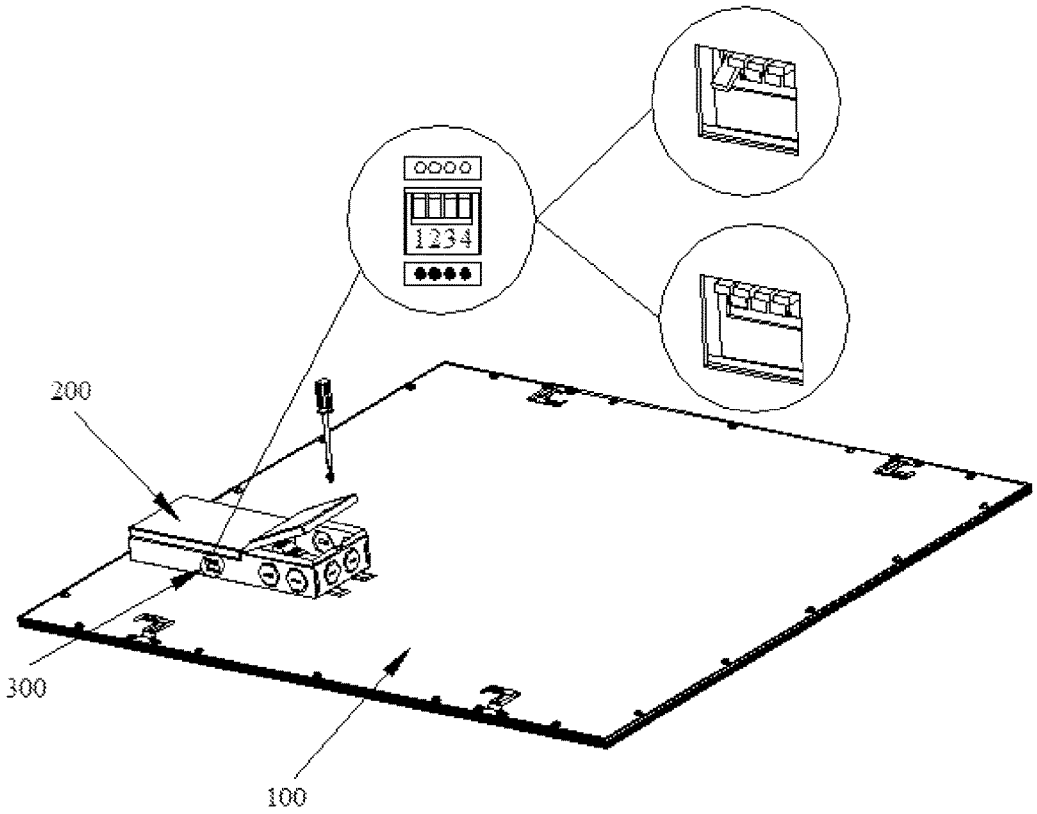
FIG. 1 is a schematic diagram showing an outer structure of an LED light device according to the present disclosure.
Figure 2:
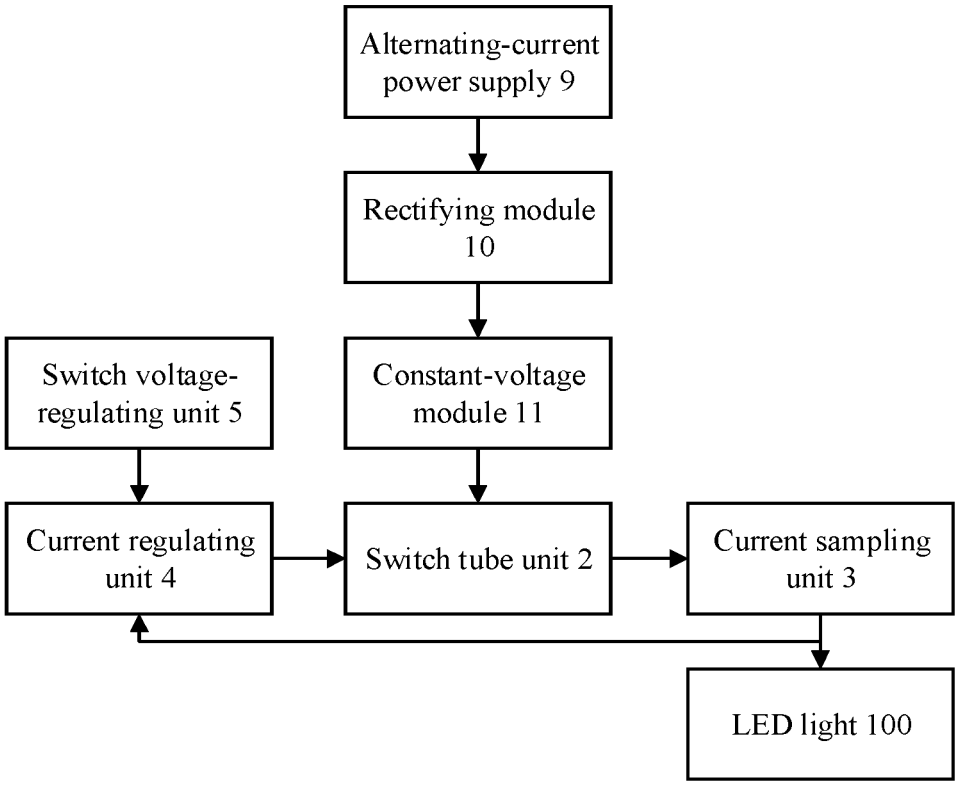
FIG. 2 is a schematic diagram showing a module structure of an LED light driving device according to an embodiment of the present disclosure.

Reference is made to FIG. 1, which is a schematic diagram showing an outer structure of an LED light device in the present disclosure. Reference is made to FIG. 2, which is a schematic diagram showing a module structure of an LED light driving device 200 according to an embodiment of the present disclosure.

An LED light device according to an embodiment of the present disclosure includes an LED light 100 and an LED light driving device 200 connected with the LED light 100. The LED light driving device 200 includes a housing, a rectifying module 10, a constant-voltage module 11 and a power regulating module. An input terminal of the rectifying module 10 is connected with an alternating-current power supply 9, and an output terminal of the rectifying module 10 is connected with an input terminal of the constant-voltage module 11. The rectifying module 10, the constant-voltage module 11 and the power regulating module are arranged in the housing.

The power regulating module includes a switch tube unit 2, a current sampling unit 3, a current regulating unit 4 and a switch voltage-regulating unit 5. A drain of the switch tube unit 2 is connected with an output terminal of the constant-voltage module 11, a source of the switch tube unit 2 is connected with the current sampling unit 3 and the LED light 100 sequentially in series, and a gate of the switch tube unit 2 is connected with a driving terminal of the current regulating unit 4. The current sampling unit 3 is configured to sample a current flowing through the LED light 100, and convert a sampled current into a voltage signal.

A sample input terminal of the current regulating unit 4 is connected between the current sampling unit 3 and the LED light 100. The current regulating unit 4 is configured to compare the voltage signal with a reference value, and control a switch-on time of the switch tube unit 2 by controlling a duty cycle of a signal at the driving terminal based on a comparison result, to enable the sampled current to be the same as the reference value. In a case that the voltage signal is the same as the reference value, a duty cycle of the signal at the driving terminal is not changed. In a case that the voltage signal is different from the reference value, the duty cycle of the signal at the driving terminal is changed.

An output terminal of the switch voltage-regulating unit 5 is connected with an input terminal of the current regulating unit 4. The switch voltage-regulating unit 5 includes at least two equivalent resistors connected in parallel and a dip switch 300 arranged in a branch where each of the equivalent resistors is located. When a combination of on-off states of the dip switches 300 is changed, an output voltage at the output terminal of the switch voltage-regulating unit 5 is changed, and the reference value is changed accordingly, so that the LED light outputs different power. The dip switches 300 are arranged at an opening on a surface of the housing.

Since the branch where each of the equivalent resistors is located has two states: an on state and an off state, the number of the combinations of on-off states of the dip switches 300 may be $2^N$, where N is the number of the equivalent resistors connected in parallel. The number of reference values corresponding to the combinations of on-off states may be $2^N$, and $2^N$ different sampled current may be outputted. Since the current sampling unit 3 is connected with the LED light 100 in series, $2^N$ different power may be outputted by the LED light 100. The dip switches 300 are arranged at the opening on the surface of the housing, therefore, the manufacturer and the user can control the dip switches 300 to be switched on or switched off at any time, and therefore regulate power of the LED light 100, thereby having advantages of regulation convenience, high practicability and low cost.

For example, if a client requires an LED light 100 having five power of 5 W, 10 W, 15 W, 20 W and 25 W, three equivalent resistors connected in parallel and a dip switch 300 arranged in a branch where each of the three equivalent resistors is located are arranged. The LED light 100 may output eight power when the dip switches 300 are controlled to be switched on or switched off. In this case, resistor values of the three equivalent resistors are calculated such that the eight power includes the five power of 5 W, 10 W, 15 W, 20 W and 25 W. Therefore, the manufacture uniformly produces an LED light device which may output the five power, and multi-power output can be realized by the LED light device for the user.

It should be illustrated that multiple resistors connected in parallel and the dip switch 300 in a branch where each of resistors is located are provided in the power regulating module, so that the LED light 100 may be regulated to output different power through different combinations of on-off states of the dip switches 300, which is an innovation point of the present disclosure. In the present disclosure, a binary encoding concept is adopted for switch-on or switch-off of the branch where each of the equivalent resistors is located.

Figure 3:
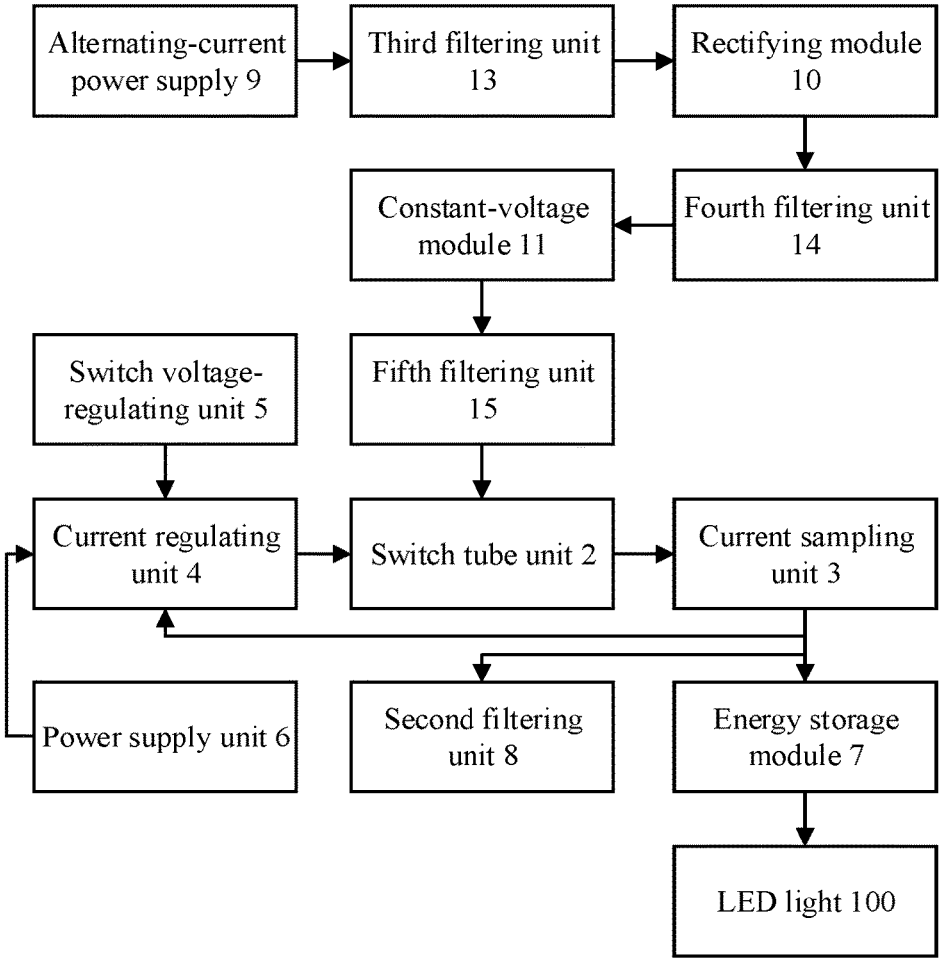
FIG. 3 is a schematic diagram showing a module structure of an LED light driving device according to another embodiment of the present disclosure.

Reference is made to FIG. 3, which is a schematic diagram of a module structure of an LED light driving device 200 according to another embodiment of the present disclosure. In an LED light device according to another embodiment of the present disclosure, the LED light driving device 200 further includes an energy storage module 7 connected in a branch where the current sampling unit 3 is located. The energy storage module 7 is configured to store electric energy or discharge electric energy to prevent the sampled current from changing abruptly.

Furthermore, the equivalent resistor may be formed by at least two resistors connected in series, at least two resistors connected in parallel or at least three resistors connected together.

Furthermore, the output terminal of the constant-voltage module 11 is connected with a first filtering unit in parallel, to stabilize an output voltage.

Furthermore, the LED light driving device 200 further includes a second filtering unit 8 connected between two terminals of the LED light 100 in parallel.

Furthermore, the LED light driving device 200 further includes a third filtering unit 13 connected between the alternating-current power supply 9 and the rectifying module 10.

Furthermore, the LED light driving device 200 further includes a fourth filtering unit 14 and a fifth filtering unit 15. The fourth filtering unit 14 is connected between the rectifying module 10 and the constant-voltage module 11, and the fifth filtering unit 15 is connected between the constant-voltage module 11 and the power regulating module.

It should be illustrated that the first filtering unit, the second filtering unit 8, the third filtering unit 13, the fourth filtering unit 14 and the fifth filtering unit 15 are used for filtering, and have multiple structures, which may be the same with each other or may be different from each other, and are not described in detail here.

Figure 4:
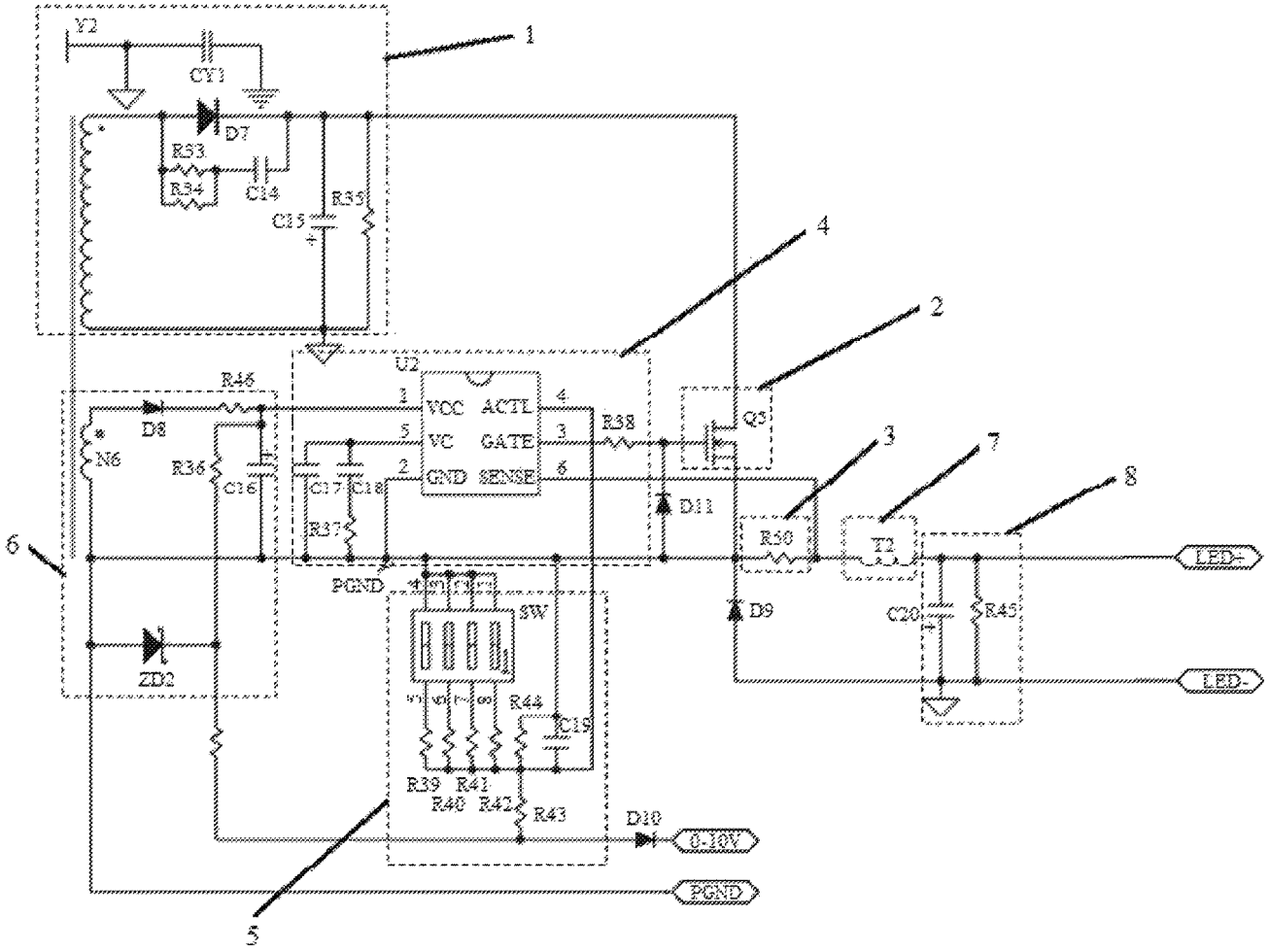
FIG. 4 is a schematic diagram showing a partial circuit structure of an LED light driving device according to the present disclosure.

Reference is made to FIG. 4, which is a schematic diagram showing a partial circuit structure of the LED light driving device 200 provided in the present disclosure. As shown in FIG. 4, the current sampling unit 3 is a resistor R50, and the switch tube unit 2 is an MOS transistor Q5.

As shown in FIG. 4, the current regulating unit 4 includes a control chip U2, a resistor R38, a resistor R37, a capacitor C17 and a capacitor C18. A first terminal of the resistor R38 is connected with a gate of the MOS transistor Q5. A pin GATE of the control chip U2 is connected with a second terminal of the resistor R38, to control the MOS transistor Q5 to be switched off or switched on. The capacitor C17 is connected between a pin VC and a pin GND of the control chip U2. The capacitor C18 and the resistor R37 are connected in series between the pin VC and the pin GND of the control chip U2, to stabilize a loop of the control chip U2. A pin SENSE of the control chip U2 is connected with an output terminal of the resistor R50, to compare a sampled voltage signal with a voltage reference value, and control a duty cycle of an output signal at the pin GATE based on a comparison result. A pin VCC of the control chip U2 is connected with a power supply unit 6, to provide an operating voltage to the control chip U2.

A pin ACTL of the control chip U2 is connected with an output terminal of the switch voltage-regulating unit 5. A diode D11 may be connected between the pin GND of the control chip U2 and the gate of the switch tube unit 2, and a cathode of the diode D11 is connected with the gate of the switch tube unit 2.

As shown in FIG. 4, the switch voltage-regulating unit 5 includes a resistor R43, a resistor R39, a resistor R40, a resistor R41, a resistor R42, a resistor R44, a capacitor C19 and dip switches SW. An external direct-current voltage source may be a direct-current voltage source of 0 to 10V. A first terminal of the resistor R43 is connected with a positive terminal of the external direct-current voltage source, and a negative terminal of the external direct-current voltage source is connected with the pin GND of the control chip U2. A second terminal of the resistor R43 is connected with the pin GND of the control chip U2 via the resistor R44. The second terminal of the resistor R43 is connected with the pin GND of the control chip U2 via the capacitor C19. The second terminal of the resistor R43 is connected with the pin ACTL of the control chip U2. The resistor R39, the resistor R40, the resistor R41 and the resistor R42 are connected in parallel between the second terminal of the resistor R43 and the pin GND of the control chip U2.

The dip switches SW may be connected in branches where the resistor R39, the resistor R40, the resistor R41 and the resistor R42 are located respectively, and a voltage at the pin ACTL of the control chip U2 is regulated by changing a combination of on-off states of the dip switches SW.

In the embodiment, a diode D10 is further connected between the first terminal of the resistor R43 and the positive terminal of the external direct-current voltage source, and the positive terminal of the external direct-current voltage source is connected with the cathode of the diode D10.

As shown in FIG. 4, the power supply unit 6 includes a transformer winding N6, a diode D8, a voltage regulating transistor ZD2, a resistor R36, a resistor R46 and a capacitor C16. A first terminal of the transformer winding N6 is connected with an anode of the diode D8, and a second terminal of the transformer winding N6 is connected with the pin GND of the control chip U2. The cathode of the diode D8 is connected with a first terminal of the resistor R46. A second terminal of the resistor R46 is connected with a first terminal of the resistor R36 and the pin VCC of the control chip U2. A second terminal of the resistor R36 is connected with a cathode of the voltage regulating transistor ZD2 and the positive terminal of the external direct-current voltage source. Furthermore, the second terminal of the resistor R36 may be connected with the anode of the diode D10 via a resistor. The anode of the voltage regulating transistor ZD2 is connected with the pin GND of the control chip U2. A positive electrode of the capacitor C16 is connected with the pin VCC of the control chip U2, and a negative electrode of the capacitor C16 is connected with the pin GND of the control chip U2.

In the circuit shown in FIG. 4, the energy storage module 7 is a transformer T2.

It should be illustrated that the LED light driving device 200 provided in the present disclosure may have multiple types of circuits, and the circuit shown in FIG. 4 may represent only one embodiment.

In the circuit shown in FIG. 4, the first filtering unit includes an electrolytic capacitor C15 and a resistor R35 connected in parallel. The second filtering unit 8 includes an electrolytic capacitor C20 and a resistor R45 connected in parallel. An anode of the electrolytic capacitor C20 is grounded.

In the circuit shown in FIG. 4, the LED light driving device 200 may further include a free-wheeling diode D9. An anode of the free-wheeling diode D9 is connected with a negative terminal of the LED light 100, and a cathode of the free-wheeling diode D9 is connected with a source of the MOS transistor Q5.

The structure and the connection manner of the LED light device are described in detail above. For convenience of description, application of the LED light device is illustrated below through an application scenario, and an example of the application includes a production stage and a usage stage.

In the production stage, the number of equivalent resistors connected in parallel in the switch voltage-regulating unit 5 is determined and a resistance value of each of the equivalent resistors is calculated according to a power requirement of the client for the LED light 100, in this way, a power regulating module may be determined and an LED light driving device 200 may be further determined. In this case, the manufacturer may produce the LED light 100 provided in the present disclosure uniformly, and power of the LED light 100 is regulated to be power required by the client by controlling the dip switches 300.

In the usage stage, the user may regulate power of the LED light 100 by controlling the dip switches 300, so that the LED light 100 may operate in different power states.

The LED light device provided in the present disclosure is described in detail above, and changes may be made onto the embodiments and application scopes by those skilled in the art based on ideas of the embodiments of the present disclosure. To sum up, contents of the specification should not be understood as a limitation to the present disclosure.

The invention claimed is:

1. A light emitting diode (LED) light device, comprising:

an LED light; and an LED light driving device connected with the LED light, wherein the LED light driving device comprises a housing, a rectifying module, a constant-voltage module and a power regulating module, wherein an input terminal of the rectifying module is connected with an alternating-current power supply, and an output terminal of the rectifying module is connected with an input terminal of the constant-voltage module;

the rectifying module, the constant-voltage module and the power regulating module are arranged in the housing;

the power regulating module comprises a switch tube unit, a current sampling unit, a current regulating unit and a switch voltage-regulating unit;

a drain of the switch tube unit is connected with an output terminal of the constant-voltage module, a source of the switch tube unit is connected with the current sampling unit and the LED light sequentially in series, and a gate of the switch tube unit is connected with a driving terminal of the current regulating unit;

the current sampling unit is configured to sample a current flowing through the LED light, and convert the sampled current into a voltage signal;

a sample input terminal of the current regulating unit is connected between the current sampling unit and the LED light, and the current regulating unit is configured to compare the voltage signal with a reference value, and control a switch-on time of the switch tube unit by controlling a duty cycle of a signal at the driving terminal based on a comparison result, to enable the sampled current to be the same as the reference value;

an output terminal of the switch voltage-regulating unit is connected with an input terminal of the current regulating unit;

the switch voltage-regulating unit comprises at least two equivalent resistors connected in parallel and a dip switch arranged in a branch where each of the equivalent resistors is located;

when a combination of on-off states of the dip switches is changed, an output voltage at the output terminal of the switch voltage-regulating unit is changed and the reference value is changed, to enable the LED light to output different power; and the dip switches are arranged at an opening on a surface of the housing.

2. The LED light device according to claim 1, wherein the LED light driving device further comprises an energy storage module connected in a branch where the current sampling unit is located, and the energy storage module is configured to store electric energy or discharge electric energy to prevent the sampled current from changing abruptly.

3. The LED light device according to claim 1, wherein the equivalent resistor is formed by at least two resistors connected in series, at least two resistors connected in parallel or at least three resistors connected together.

4. The LED light device according to claim 1, wherein the output terminal of the constant-voltage module is connected with a first filtering unit in parallel, to stabilize an output voltage.

5. The LED light device according to claim 1, wherein the LED light driving device further comprises a second filtering unit connected between two terminals of the LED light in parallel.

6. The LED light device according to claim 1, wherein the LED light driving device further comprises a third filtering unit connected between the alternating-current power supply and the rectifying module.

7. The LED light device according to claim 1, wherein the current sampling unit is a resistor R50, and the switch tube unit is a metal oxide semiconductor (MOS) transistor Q5.

8. The LED light device according to claim 7, wherein the current regulating unit comprises a control chip U2, a resistor R38, a resistor R37, a capacitor C17 and a capacitor C18, wherein a first terminal of the resistor R38 is connected with a gate of the MOS transistor Q5;

a pin GATE of the control chip U2 is connected with a second terminal of the resistor R38, to control the MOS transistor Q5 to be switched on or switched off;

the capacitor C17 is connected between a pin VC and a pin GND of the control chip U2;

the capacitor C18 and the resistor R37 are connected in series between the pin VC and the pin GND of the control chip U2, to stabilize a loop of the control chip U2;

a pin SENSE of the control chip U2 is connected with an output terminal of the resistor R50, to compare a sampled voltage signal with a voltage reference value, and control a duty cycle of an output signal at the pin GATE based on a comparison result;

a pin VCC of the control chip U2 is connected with a power supply unit, to provide an operating voltage to the control chip U2; and a pin ACTL of the control chip U2 is connected with the output terminal of the switch voltage-regulating unit.

9. The LED light device according to claim 8, wherein the switch voltage-regulating unit comprises a resistor R43, a resistor R39, a resistor R40, a resistor R41, a resistor R42, a resistor R44, a capacitor C19 and dip switches SW, wherein a first terminal of the resistor R43 is connected with a positive terminal of an external direct-current voltage source, and a negative terminal of the external direct-current voltage source is connected with the pin GND of the control chip U2;

an anode of a diode D10 is connected with the first terminal of the resistor R43;

a second terminal of the resistor R43 is connected with the pin GND of the control chip U2 via the resistor R44;

the second terminal of the resistor R43 is connected with the pin GND of the control chip U2 via the capacitor C19;

the second terminal of the resistor R43 is connected with the pin ACTL of the control chip U2;

the resistor R39, the resistor R40, the resistor R41 and the resistor R42 are connected in parallel between the second terminal of the resistor R43 and the pin GND of the control chip U2; and the dip switches SW are connected in branches where the resistor R39, the resistor R40, the resistor R41 and the resistor R42 are located respectively, and a voltage at the pin ACTL of the control chip U2 is regulated by changing a combination of on-off states of the dip switches SW.

10. The LED light device according to claim 9, wherein the power supply unit comprises a transformer winding N6, a diode D8, a voltage regulating transistor ZD2, a resistor R36, a resistor R46 and a capacitor C16, wherein a first terminal of the transformer winding N6 is connected with an anode of the diode D8, and a second terminal of the transformer winding N6 is connected with the pin GND of the control chip U2;

a cathode of the diode D8 is connected with a first terminal of the resistor R46;

a second terminal of the resistor R46 is connected with a first terminal of the resistor R36 and the pin VCC of the control chip U2;

a second terminal of the resistor R36 is connected with a cathode of the voltage regulating transistor ZD2 and the positive terminal of the external direct-current voltage source;

an anode of the voltage regulating transistor ZD2 is connected with the pin GND of the control chip U2; and a positive electrode of the capacitor C16 is connected with the pin VCC of the control chip U2, and a negative electrode of the capacitor C16 is connected with the pin GND of the control chip U2.

* * * * *